US006467949B1

(12) United States Patent
Reeder et al.

(10) Patent No.: US 6,467,949 B1
(45) Date of Patent: Oct. 22, 2002

(54) STATIC MIXER ELEMENT AND METHOD FOR MIXING TWO FLUIDS

(75) Inventors: Mark F. Reeder, Tipp City; Kevin J. Myers, Dayton; Julian Fasano, Englewood, all of OH (US)

(73) Assignee: Chemineer, Inc., Dayton, OH (US)

( * ) Notice: Subject to any disclaimer, the term of this patent is extended or adjusted under 35 U.S.C. 154(b) by 0 days.

(21) Appl. No.: 09/630,397

(22) Filed: Aug. 2, 2000

(51) Int. Cl.[7] ..... B01F 5/06
(52) U.S. Cl. ..... 366/338
(58) Field of Search ..... 366/336, 337, 366/338, 339

(56) References Cited

U.S. PATENT DOCUMENTS

| | | | | |
|---|---|---|---|---|
| 2,747,930 A | | 5/1956 | Hyde | |
| 3,460,819 A | | 8/1969 | Pike | |
| 4,061,313 A | | 12/1977 | Brauner et al. | 366/340 |
| 4,211,277 A | | 7/1980 | Grosz-Röll et al. | 165/109.1 |
| 4,461,579 A | | 7/1984 | McCallum | 366/337 |
| 4,543,185 A | | 9/1985 | Reid | 210/194 |
| 4,674,888 A | | 6/1987 | Carlson | 366/337 |
| 4,744,928 A | * | 5/1988 | Werner | 366/337 |
| 4,749,527 A | | 6/1988 | Rasmusen | 366/339 |
| 4,765,204 A | | 8/1988 | Buchholz et al. | 366/337 |
| 4,824,614 A | | 4/1989 | Jones | 366/337 |
| 4,874,249 A | * | 10/1989 | Kabátek et al. | 366/338 |
| 5,215,375 A | | 6/1993 | Ditzler et al. | 366/337 |
| 5,378,063 A | * | 1/1995 | Tsukada | 366/337 |
| 5,484,203 A | * | 1/1996 | King | 366/337 |
| 5,492,408 A | | 2/1996 | Alfarė | 366/337 |
| 5,520,460 A | | 5/1996 | Lantz | 366/337 |
| 5,522,661 A | * | 6/1996 | Tsukada | 366/337 |
| 5,654,008 A | * | 8/1997 | Herbert et al. | |
| 5,688,047 A | | 11/1997 | Signer | 366/337 |
| 5,971,603 A | | 10/1999 | Davis et al. | 366/337 |
| 6,042,263 A | | 3/2000 | Mentzer et al. | 366/340 |
| 6,224,833 B1 | * | 5/2001 | Rall | |

* cited by examiner

*Primary Examiner*—Tony G. Soohoo
(74) *Attorney, Agent, or Firm*—Thompson Hine LLP

(57) ABSTRACT

A static mixer element and a method for mixing first and second (or more) fluids using a static mixer element. The static mixer element includes a directional flow axis which points in an intended downstream direction opposite to an intended upstream direction. The static mixer element also includes interdigitated static mixer blades. The blades each have a concave side which faces generally in the intended upstream direction at an acute angle with respect to the intended upstream direction. The static mixer element is placed in a pipe with the directional flow axis of the static mixer element pointing downstream. The first and second fluids are introduced into the pipe upstream from the static mixer element. Optionally, other static mixer elements can be added downstream, wherein even-numbered elements are rotated ninety-degrees about the directional flow axis from odd-numbered static mixer elements.

24 Claims, 6 Drawing Sheets

STATIC MIXER ELEMENT AND METHOD FOR MIXING TWO FLUIDS

FIELD OF THE INVENTION

The present invention relates generally to mixing two or more fluids, and more particularly to a static mixing element and to a method for mixing such fluids.

BACKGROUND OF INVENTION

Mixing of two or more fluids is accomplished by conventional dynamic mixers having moving parts and by conventional static mixers having stationary parts. Disadvantages of dynamic mixers include increased maintenance and repair.

Known methods for mixing two or more fluids include placing a conventional static mixer element in a pipe and introducing the fluids into the pipe upstream from the static mixer element. The conventional static mixer element is secured in the pipe or is secured to a section of pipe which then is attached to upstream and downstream pipe sections.

Known static mixer elements include those having perpendicularly interdigitated mixer blades having planar blade surfaces inclined forty-five degrees to the direction of fluid flow. Typically the fluids are liquids. The fluids are mixed as they pass through the openings between the mixer blades. Mixing is improved by increasing the length of the static mixer element or by adding additional static mixer elements, but this increases pressure drop. High-viscosity fluids are typically more difficult to mix than low-viscosity fluids. It is also difficult to mix a low-viscosity fluid and a highly-viscous fluid.

What is needed is an apparatus and an efficient method for better mixing together of two or more fluids, especially when the fluids have widely disparate viscosities such as when one fluid has low viscosity and another fluid is highly-viscous.

SUMMARY OF THE INVENTION

A first expression of a preferred embodiment of the invention is for a static mixer element. The static mixer element includes a directional flow axis and interdigitated static mixer blades. The directional flow axis passes through the center of gravity of the static mixer element and points in an intended downstream direction opposite to an intended upstream direction. The static mixer blades each have a concave side facing generally in the intended upstream direction at an acute angle with respect to the intended upstream direction. A plane perpendicular to, and moving in the direction of, the directional flow axis will first and generally simultaneously strike a subset of the static mixer blades. Some of the static mixer blades of the subset are positioned at a positive acute angle with respect to the intended upstream direction. The remainder of the static mixer blades of the subset are positioned at a negative acute angle with respect to the intended upstream direction.

A second expression of a preferred embodiment of the invention is for a static mixer element. The static mixer element includes a directional flow axis, a first group of spaced-apart and generally-aligned blade layers, and a second group of spaced-apart and generally-aligned blade layers. The directional flow axis passes through the center of gravity of the static mixer element and points in an intended downstream direction opposite to an intended upstream direction. Each blade layer of the first group has spaced-apart and generally-aligned static mixer blades each having a concave side facing generally in the intended upstream direction at an acute angle with respect to the intended upstream direction. The blade layers of the second group are aligned generally perpendicular to the blade layers of the first group. Each blade layer of the second group has spaced-apart and generally-aligned static mixer blades each having a concave side facing generally in the intended upstream direction at an acute angle with respect to the intended upstream direction. The static mixer blades of the blade layers of the second group are interdigitated with, and connected to, the static mixer blades of the blade layers of the first group. A plane perpendicular to, and moving in the direction of, the directional flow axis will first and generally simultaneously strike at least one static mixer blade from each of at least two blade layers of each of the first and second groups.

A first expression of a preferred method of the invention is for mixing first and second fluids and includes steps a) through e). Step a) includes obtaining a pipe. Step b) includes obtaining a static mixer element, wherein the static mixer element includes a directional flow axis and a multiplicity of interdigitated static mixer blades. The directional flow axis passes through the center of gravity of the static mixer element and points in an intended downstream direction opposite to an intended upstream direction. The static mixer blades each have a concave side facing generally in the intended upstream direction at an acute angle with respect to the intended upstream direction. Step c) includes positioning the static mixer element in the pipe with the directional flow axis pointing downstream. Step d) includes placing the first fluid in the pipe upstream from the static mixer element. Step e) includes placing the second fluid in the pipe upstream from the static mixer element.

A second expression of a preferred method of the invention is for mixing first and second fluids and includes steps a) through e). Step a) includes obtaining a pipe. Step b) includes obtaining a static mixer element identical to that described in the second previous paragraph. Step c) includes positioning the static mixer element in the pipe with the directional flow axis pointing downstream. Step d) includes placing the first fluid in the pipe upstream from the static mixer element. Step e) includes placing the second fluid in the pipe upstream from the static mixer element.

A second preferred embodiment of the invention is for a static mixer element assembly which includes first and second static mixer elements. The first static mixer element is identical to the static mixer element of the above-described second expression of a preferred embodiment of the invention. The second static mixer element is substantially identical to the first static mixer element, is positioned to have its directional flow axis substantially superimposed on the directional flow axis of the first static mixer element, is rotated generally ninety degrees with respect to the first static mixer element about the directional flow axis of the first static mixer element, and is positioned proximate the first static mixer element.

A second preferred method of the invention is for mixing first and second fluids and includes the steps of the above-described second expression of a preferred method of the invention, wherein "first static mixer element" replaces "static mixer element". The second preferred method also includes several additional steps. A first additional step includes obtaining a second static mixer element substantially identical to the first static mixer element. A second additional step includes positioning the second static mixer element in the pipe downstream of the first static mixer element with the directional flow axis of the second static mixer element pointing downstream and with the second static mixer element rotated generally ninety degrees with respect to the first static mixer element about the directional flow axis of the first static mixer element.

Several benefits and advantages are derived from the invention. Using static mixer blades having a concave surface facing generally upstream at an acute angle resulted in better mixing than that achieved using the flat blades of the prior art. In experiments involving mixing water and corn syrup, the curved blades of the invention showed about a twelve percent improvement in mixedness over the flat blades of the prior art for vertical mixing (i.e., when the two fluids flowed vertically upward) and showed over a thirty percent improvement in mixedness for horizontal mixing (i.e., when the two fluids flowed horizontally). Even a twelve percent improvement is significant and means that eleven static mixer elements having the curved blades of the invention would provide the same or better mixedness as twelve static mixer elements having the flat blades of the prior art. The pressure drop from the curved blades of the invention was about five percent lower than that of the flat blades of the prior art. The lower pressure drop can result in an increased throughput in those applications where it is desirable to minimize pressure drop for a given static mixer element length and means a static mixer element having a shorter length in those applications where length, instead of lower pressure drop, is the critical design parameter. It is noted that comparisons of the mixing performance of curved and flat blades were made for static mixer elements of identical length (measured along the directional flow axis) having the same blade intersection area and the same interface area between blades. Applicants discovered that there were more droplets of low-viscosity fluid (the water) forced to the pipe walls by cross-stream flow by the curved blades of the invention than by the flat blades of the prior art. Applicants also discovered that the droplets of low-viscosity fluid (the water) tended to migrate around the flat blades of the prior art nearer to the center portion of the pipe rather than being driven in cross-stream flow toward the pipe wall. This has led Applicants to theorize that improvement in cross-stream flow toward the pipe wall accounts for the improvement in mixedness of the curved blades of the invention.

DETAILED DESCRIPTION

Figure 1:
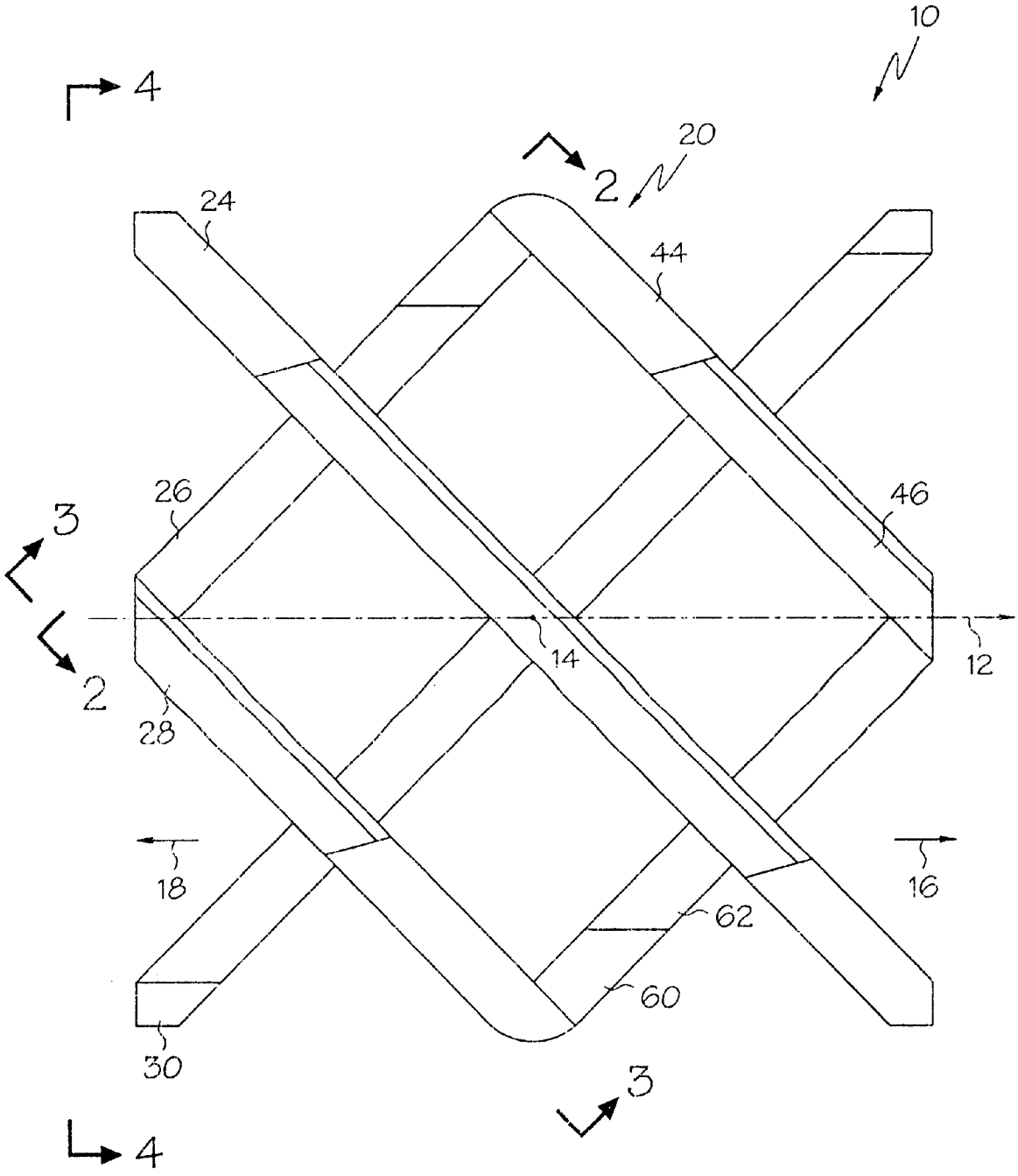
FIG. 1 is a side view of a preferred embodiment of the static mixer element of the invention.

A preferred embodiment of the invention is shown in FIGS. 1 through 4. A first expression of the preferred embodiment of the invention is for a static mixer element 10. The static mixer element 10 has a directional flow axis 12 which passes through the center of gravity 14 of the static mixer element 10 and which points in an intended downstream direction 16 opposite to an intended upstream direction 18. It is noted that when the static mixer element 10 is disposed in a pipe (not shown) in which two or more fluids (not shown) are flowing, the static mixer element 10 is disposed so that the directional flow axis 12 points downstream whereby the intended downstream direction 16 points downstream and the intended upstream direction 18 points upstream. The static mixer element 10 also has a multiplicity of interdigitated static mixer blades (identified generally by the number 20 in the figures) each having a concave side 22 facing generally in the intended upstream direction 18 at an acute angle (i.e., an angle less than ninety degrees) with respect to the intended upstream direction 18. By way of illustration, it is noted that interdigitated static mixer blades 20 may be likened to a person's fingers when a person clasps or folds together his or her hands with interlocking fingers but keeps the fingers straight and not bent. By "facing generally in the intended upstream direction 18" is meant that fluid flowing in the direction of the directional flow axis 12 will impact the concave side 22 of the blades 20 and not the opposite side of the blades 20. A plane (i.e., a geometric plane) perpendicular to, and moving in the direction of, the directional flow axis 12 will first and generally simultaneously strike a subset (blades 24, 26, 28, and 30 as seen in FIG. 1) of the static mixer blades 20. Some (blades 24 and 28 as seen in FIG. 1) of the static mixer blades 20 of the subset are positioned at a positive acute angle with respect to the intended upstream direction 18 (i.e., the concave side 22 of such blades 24 and 28 in FIG. 1 are shown inclined in a clockwise direction at an acute angle from the intended upstream direction 18), and the remainder (blades 26 and 30 as seen in FIG. 1) of the static mixer blades 20 of the subset are positioned at a negative acute angle with respect to the intended upstream direction 18 (i.e., the concave side 22 of such blades 26 and 30 in FIG. 1 are shown declined in a counterclockwise direction at an acute angle from the intended upstream direction 18).

It is noted that the blades 20, including the upstream-most portions of blades 26 and 28, will divert downstream-moving fluid in a cross-stream direction towards a surrounding pipe wall (not shown), as can be appreciated by the artisan. Preferably, the interdigitated static mixer blades 20 are generally-perpendicularly interdigitated static mixer blades. It is also preferred that the absolute value of the acute angle is generally forty-five degrees for each of the static mixer blades 20. Preferably, the center of gravity 14 of the static mixer element 10 is the center of gravity of the totality of the static mixer blades 20.

A second expression of the preferred embodiment of the invention is for a static mixer element 10. The static mixer element 10 has a directional flow axis 12 which passes through the center of gravity 14 of the static mixer element 10 and which points in an intended downstream direction 16 opposite to an intended upstream direction 18.

Figure 2:
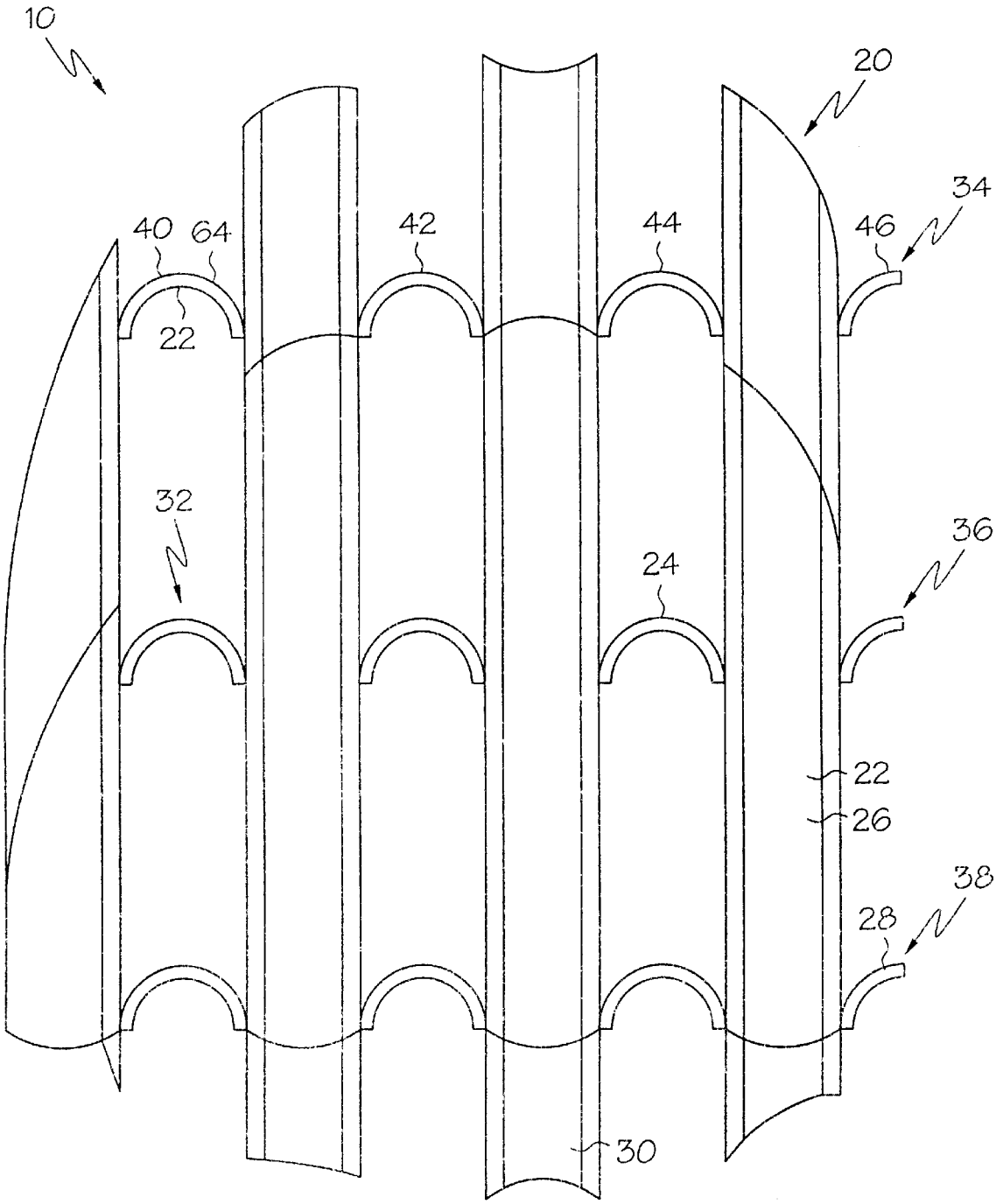
FIG. 2 is a view taken along lines 2—2 in FIG. 1.

The static mixer element 10 also has a first group 32 of spaced-apart and generally-aligned blade layers 34, 36, and 38. Each blade layer 34, 36, and 38 of the first group 32 has a plurality of spaced-apart and generally-aligned static mixer blades 20 each having a concave side 22 facing generally in the intended upstream direction 18 at an acute angle with respect to the intended upstream direction 18. For example, blade layer 34 contains blades 40, 42, 44, and 46 as seen in FIG. 2.

Figure 3:
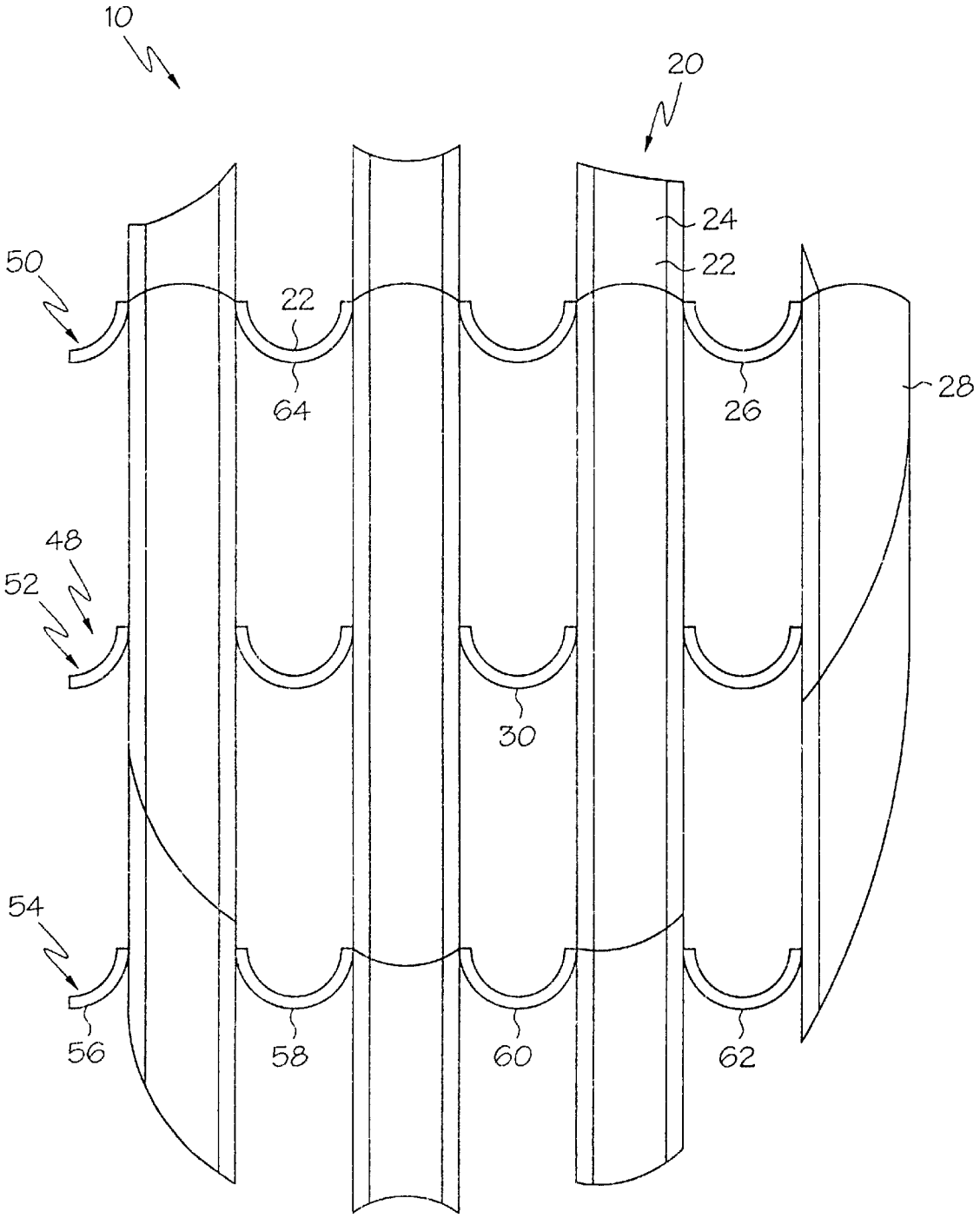
FIG. 3 is a view taken along lines 3—3 in FIG. 1.

The static mixer element 10 further has a second group 48 of spaced-apart and generally-aligned blade layers 50, 52, and 54. The blade layers 50, 52, and 54 of the second group 48 are aligned generally perpendicular to the blade layers 34, 36, and 38 of the first group 32. Each blade layer 50, 52, and 54 of the second group 48 has a plurality of spaced-apart and generally-aligned static mixer blades 20 each having a concave side 22 facing generally in the intended upstream direction 18 at an acute angle with respect to the intended upstream direction 18. For example, blade layer 54 contains blades 56, 58, 60, and 62 as seen in FIG. 3. The static mixer blades 20 of the blade layers 50, 52, and 54 of the second group 48 are interdigitated with, and connected to, the static mixer blades 20 of the blade layers 34, 36, and 38 of the first group 32. A plane (i.e., a geometric plane) perpendicular to, and moving in the direction of, the directional flow axis 12 will first and generally simultaneously strike at least one static mixer blade from each of at least two blade layers of each of the first and second groups. For example, as can be appreciated from FIGS. 1–3, the plane will so strike blade 24 of layer 36 and blade 28 of layer 38 of the first group 32 and blade 26 of layer 50 and blade 30 of layer 52 of the second group 48.

It is noted that the blades 20, including the upstream-most portions of blades 26 and 28, will divert downstream-moving fluid in a cross-stream direction towards a surrounding pipe wall (not shown), as can be appreciated by the artisan. Preferably, the acute angle of the static mixer blades 20 of each blade layer 34, 36, and 38 of the first group 32 is generally plus forty-five degrees, and the acute angle of the static mixer blades 20 of each blade layer 50, 52, and 54 of the second group 48 is generally minus forty-five degrees. In a preferred construction, the static mixer blades 20 of each blade layer of the first and second groups have a convex side 64 opposing the concave side 22 and have a generally uniform blade thickness between the convex and concave sides 64 and 22. Although not shown in the figures, preferably, the concave side 22 extends further in arc than the convex side 64 so that the concave and convex sides 22 and 64 of each static mixer blade 20 are connected together by two vertical edges instead of by the two horizontal edges shown in FIGS. 2 and 3.

In a preferred design, the first group 32 has at least three blade layers 34, 36, and 38 including two outermost blade layers 34 and 38 and at least one intermediate blade layer 36 disposed between the two outermost blade layers 34 and 38 of the first group 32 Likewise, the second group 48 has at least three blade layers 50, 52, and 54 including two outermost blade layers 50 and 54 and at least one intermediate blade layer 52 disposed between the two outermost blade layers 50 and 54 of the second group 48. The static mixer blades 20 of the outermost blade layers 34 and 38 of the first group 32 are shorter in length than the static mixer blades 20 of the at least one intermediate blade layer 36 of the first group 32. Likewise, the static mixer blades 20 of the outermost blade layers 50 and 54 of the second group 48 are shorter in length than the static mixer blades 20 of the at least one intermediate blade layer 52 of the second group 48.

Figure 4:
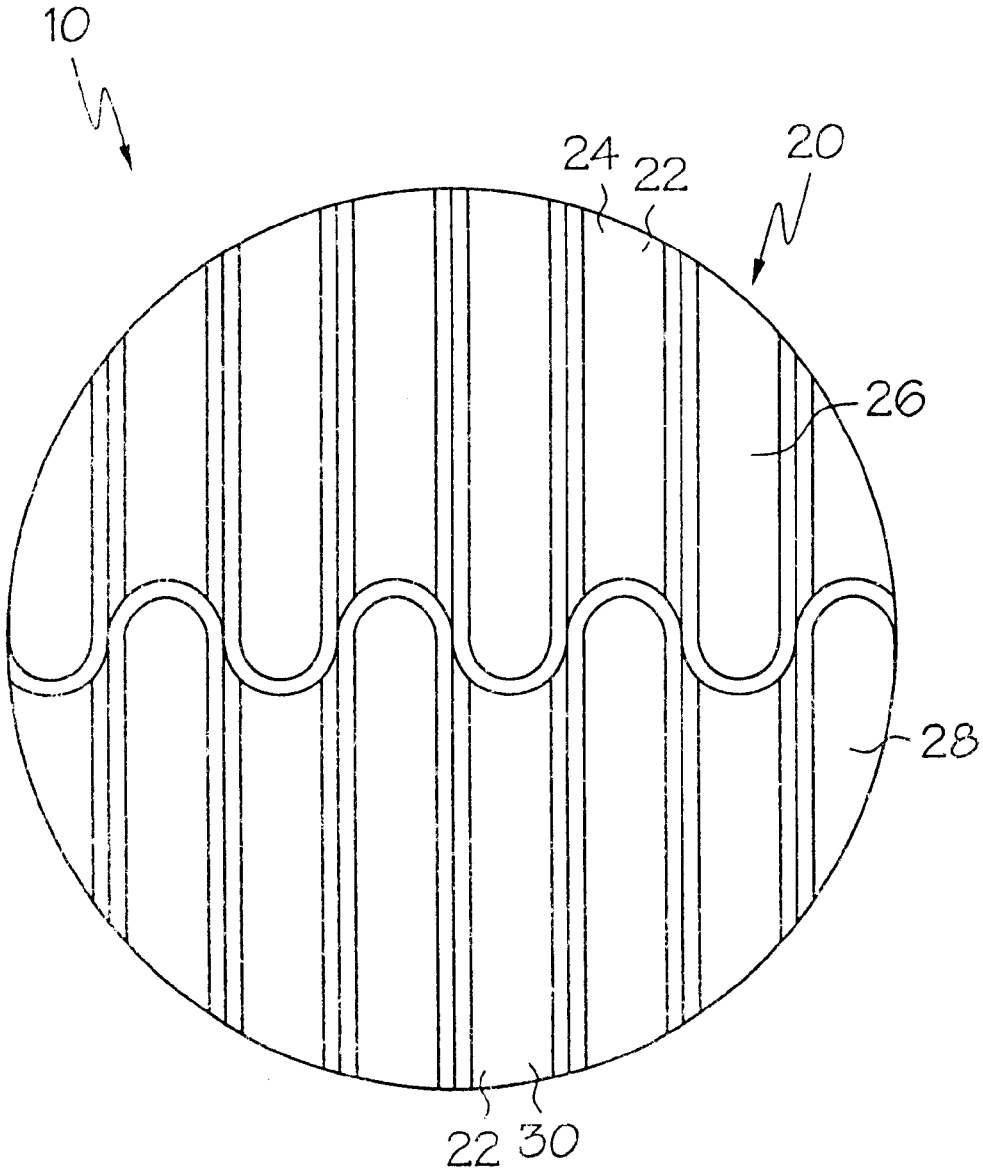
FIG. 4 is a front view taken along lines 4—4 in FIG. 1.

Preferably, the concave side 22 of each static mixer blade 20 has a generally constant radius of curvature. In a preferred design, and as seen in FIGS. 2 and 3, the concave side 22 of at least one of the static mixer blades of each blade layer of each of the first and second groups is a generally semi-circular concave side. Preferably, a generally semi-circular concave side is a concave side which constitutes between 130 degrees and 180 degrees of a full circle. For example, the concave side 22 of blade 40 of layer 34 of the first group 32 has a semi-circular shape, as seen in FIG. 2. In a preferred geometry, and as seen in FIG. 4, the static mixer blades 20 of the blade layers of the first and second groups together have a generally circular outline when viewed along the directional flow axis 12 (i.e., when looking at the front of the static mixer element 10 which is the same as when looking downstream at the static mixer element 10).

Figure 5:
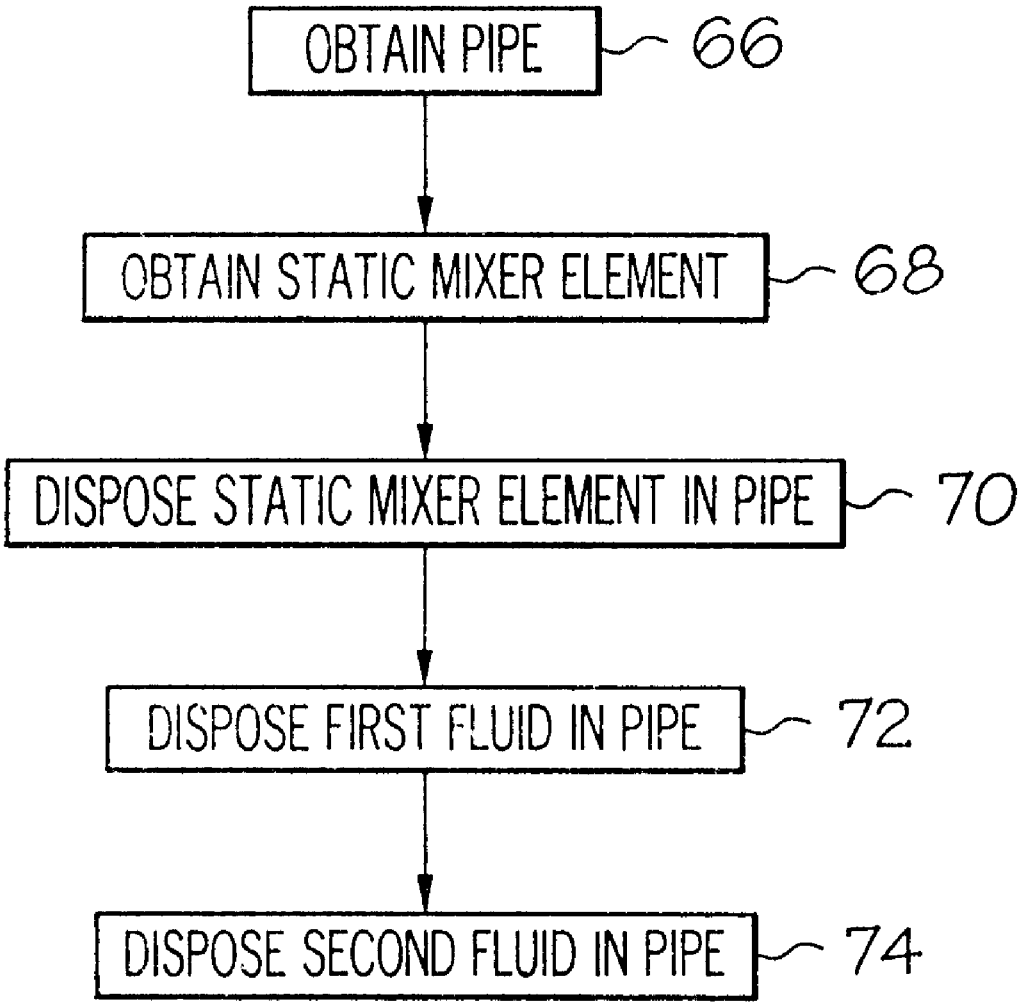
FIG. 5 is a block diagram of a preferred method of the invention for mixing first and second fluids.

A preferred method of the invention is shown in FIG. 5. A first expression of the preferred method of the invention is for mixing first and second (or more) fluids and includes steps a) through e) which are outlined in the block diagram of FIG. 5. Step a) is shown in block 66 of FIG. 5 as "Obtain Pipe". Step a) includes the step of obtaining a pipe. Typically the pipe has a circular cross section when looking upstream or downstream.

Step b) is shown in block 68 of FIG. 5 as "Obtain Static Mixer Element". Step b) includes the step of obtaining a static mixer element 10. The static mixer element 10 has a directional flow axis 12 which passes through the center of gravity 14 of the static mixer element 10 and which points in an intended downstream direction 16 opposite to an intended upstream direction 18. The static mixer element 10 also has a multiplicity of interdigitated static mixer blades (identified generally by the number 20 in the figures) each having a concave side 22 facing generally in the intended upstream direction 18 at an acute angle (i.e., an angle less than ninety degrees) with respect to the intended upstream direction 18.

Step c) is shown in block 70 of FIG. 5 as "Dispose Static Mixer Element In Pipe". Step c) includes disposing the static mixer element 10 in a pipe with the directional flow axis 12 pointing downstream. Step d) is shown in block 72 of FIG. 5 as "Dispose First Fluid In Pipe". Step d) includes disposing the first fluid in the pipe upstream from the static mixer element 10. Step e) is shown in block 74 of FIG. 5 as "Dispose Second Fluid In Pipe". Step e) includes disposing the second fluid in the pipe upstream from the static mixer element 10.

Although not necessary (as required in the previous description of the first expression of the preferred embodiment of the invention), preferably, in this first expression of the preferred method of the invention, a plane (i.e., a geometric plane) perpendicular to, and moving in the direction of, the directional flow axis 12 will first and generally simultaneously strike a subset (blades 24, 26, 28, and 30 as seen in FIG. 1) of the static mixer blades 20. Preferably, but not necessarily, some (blades 24 and 28 as seen in FIG. 1) of the static mixer blades 20 of the subset are positioned at a positive acute angle with respect to the intended upstream direction 18, and the remainder (blades 26 and 30 as seen in FIG. 1) of the static mixer blades 20 of the subset are positioned at a negative acute angle with respect to the intended upstream direction 18.

It is noted that, in the preferred arrangement described in the previous paragraph, the blades 20, including the upstream-most portions of blades 26 and 28, will divert downstream-moving fluid in a cross-stream direction towards a surrounding pipe wall (not shown), as can be appreciated by the artisan. Preferably, the interdigitated static mixer blades 20 are generally-perpendicularly interdigitated static mixer blades. It is also preferred that the absolute value of the acute angle is generally forty-five degrees for each of the static mixer blades 20.

A second expression of the preferred method of the invention is for mixing first and second (or more) fluids and includes steps a) through e) which are outlined in the block diagram of FIG. 5. The second expression of the preferred method is identical to the previously-described first expression of the preferred method except for the description of the static mixer element 10 obtained in step b). In this second expression of the preferred method, the static mixer element 10 obtained in step b) is identical to the static mixer element 10 previously described in the second expression of the preferred embodiment of the invention. In a preferred application of the method, the ratio of the viscosity of the first fluid to the viscosity of the second fluid is at least ten thousand to one. Preferably, the circular outline of the static mixer blades 20, when viewed along the directional flow axis 12, has a diameter generally equal to the inside diameter of the pipe (not shown) in which the static mixer element 10 is disposed.

It is noted that it is within the level of skill of the artisan to choose a material (or materials) for the static mixer element 10 which is strong enough to withstand the expected fluid flow without breaking and which will not chemically interact with any intended unmixed fluid or with any resulting mixed fluids. Depending on the application, the choice of material(s) includes stainless steel and plastic. In a preferred design, the thickness of the blade 20 is generally uniform having a value of from generally 0.03 to generally 0.15 inch. A preferred static mixer element 10 has exactly two groups (i.e., first and second groups 32 and 48) and has exactly three blade layers 34, 36, and 38 in its first group 32 and exactly three blade layers 50, 52, and 54 in its second group 48, as shown in FIGS. 1–3. To fit inside a two-inch inside-diameter pipe, a preferred static mixer element 10 has a length (measured along the directional flow axis 12) of generally two inches. For certain mixing applications, two or more static mixer elements 10 are placed in series in the pipe. Preferably, the fluids to be mixed are liquids. However, in certain applications, one or more or all of the fluids are gasses.

Figure 6:
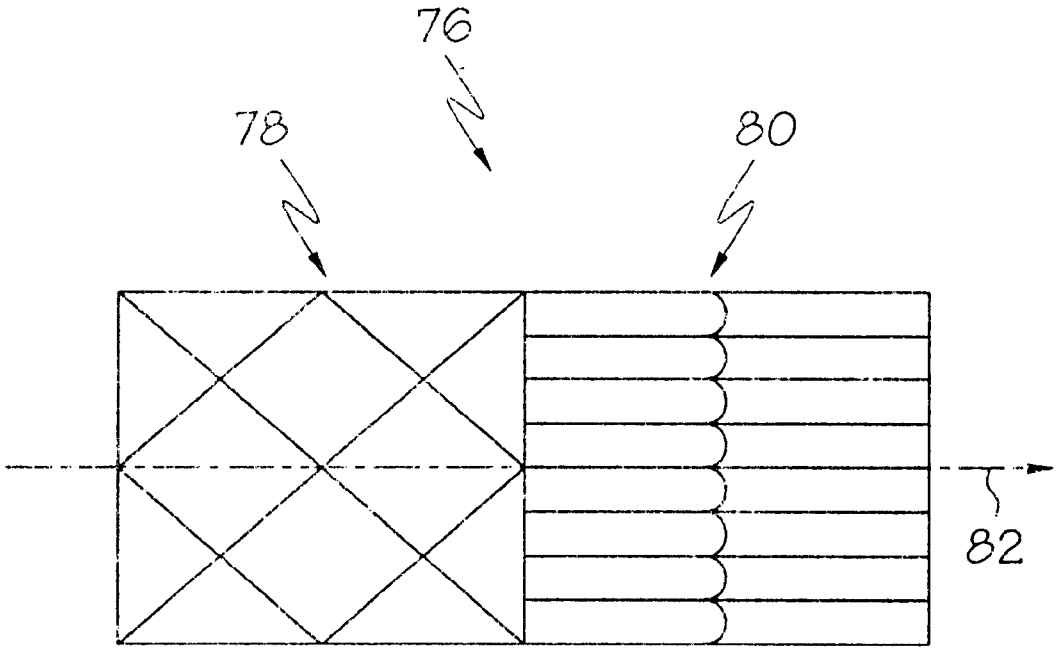
FIG. 6 is a schematic side view of a preferred embodiment of the static mixer element assembly of the invention.

A second preferred embodiment of the invention, shown in FIG. 6, is for a static mixer element assembly 76. The static mixer element assembly 76 includes first and second static mixer elements 78 and 80. The first static mixer element 78 is identical to the static mixer element 10 of the above-described second expression of a preferred embodiment of the invention The second static mixer element 80 is substantially identical to the first static mixer element 78, is disposed to have its directional flow axis substantially superimposed on the directional flow axis 82 of the first static mixer element 78, is rotated generally ninety degrees with respect to the first static mixer element 78 about the directional flow axis 82 of the first static mixer element 78, and is disposed proximate the first static mixer element 78. Preferably, the second static mixer element 80 abuts the first static mixer element 78. In one example, the second static mixer element 80 is attached to the first static mixer element 78. Other static mixer elements (not shown) can be added to the static mixer element assembly with the third static mixer element added downstream of the second static mixer element and oriented substantially identical to the first static mixer element, with the fourth static mixer element added downstream of the third static mixer element assembly and oriented substantially identical to the second static mixer element, etc.

A second preferred method of the invention is for mixing first and second fluids and includes the steps of the above-described second expression of a preferred method of the invention, wherein "first static mixer element 78" replaces "static mixer element 10". The second preferred method also includes several additional steps. A first additional step includes obtaining a second static mixer element 80 substantially identical to the first static mixer element 78. A second additional step includes positioning the second static mixer element 80 in the pipe downstream of the first static mixer element 78 with the directional flow axis of the second static mixer element 80 pointing downstream and with the second static mixer element 80 rotated generally ninety degrees with respect to the first static mixer element 78 about the directional flow axis 82 of the first static mixer element 78. Preferably, the second additional step includes disposing the second static mixer element 80 in contact with the first static mixer element 78. Other static mixer elements (not shown) can be added to the method with the third static mixer element added downstream of the second static mixer element and oriented substantially identical to the first static mixer element, with the fourth static mixer element added downstream of the third static mixer element assembly and oriented substantially identical to the second static mixer element, etc.

Several benefits and advantages are derived from the invention. Using static mixer blades having a concave surface facing generally upstream at an acute angle resulted in better mixing than that achieved using the flat blades of the prior art. In experiments involving mixing water and corn syrup, the curved blades of the invention showed about a twelve percent improvement in mixedness over the flat blades of the prior art for vertical mixing (i.e., when the two fluids flowed vertically upward) and showed over a thirty percent improvement in mixedness for horizontal mixing (i.e., when the two fluids flowed horizontally). Even a twelve percent improvement is significant and means that eleven static mixer elements having the curved blades of the invention would provide the same or better mixedness as twelve static mixer elements having the flat blades of the prior art. The pressure drop from the curved blades of the invention was about five percent lower than that of the flat blades of the prior art. The lower pressure drop can result in an increased throughput in those applications where it is desirable to minimize pressure drop for a given static mixer element length and means a static mixer element having a shorter length in those applications where length, instead of lower pressure drop, is the critical design parameter. It is noted that comparisons of the mixing performance of curved and flat blades were made for static mixer elements of identical length (measured along the directional flow axis) having the same blade intersection area and the same interface area between blades. Applicants discovered that there were more droplets of low-viscosity fluid (the water) forced to the pipe walls by cross-stream flow by the curved blades of the invention than by the flat blades of the prior art. Applicants also discovered that the droplets of low-viscosity fluid (the water) tended to migrate around the flat blades of the prior art nearer to the center portion of the pipe rather than being driven in cross-stream flow toward the pipe wall. This has led Applicants to theorize that improvement in cross-stream flow toward the pipe wall accounts for the improvement in mixedness of the curved blades of the invention.

The foregoing description of several expressions of a preferred embodiment of the invention and several expressions of a preferred method of the invention has been presented for purposes of illustration. It is not intended to be exhaustive or to limit the invention to the precise form and process disclosed, and obviously many modifications and variations are possible in light of the above teaching. It is intended that the scope of the invention be defined by the claims appended hereto.

What is claimed is:

1. A static mixer element comprising:

a) a directional flow axis which passes through the center of gravity of the static mixer element and which points in an intended downstream direction opposite to an intended upstream direction; and b) a multiplicity of interdigitated static mixer blades each having a concave side facing generally in the intended upstream direction at an acute angle with respect to the intended upstream direction, wherein a plane perpendicular to, and moving in the direction of, the directional flow axis will first and generally simultaneously strike a subset of the static mixer blades, some of the static mixer blades of the subset disposed at a positive acute angle with respect to the intended upstream direction and the remainder of the static mixer blades of the subset disposed at a negative acute angle with respect to the intended upstream direction.

2. The static mixer element of claim 1, wherein the interdigitated static mixer blades are generally-perpendicularly interdigitated static mixer blades.

3. The static mixer element of claim 1, wherein the absolute value of the acute angle is generally forty-five degrees for each of the static mixer blades.

4. A static mixer element comprising:

a) a directional flow axis which passes through the center of gravity of the static mixer element and which points in an intended downstream direction opposite to an intended upstream direction;

b) a first group of spaced-apart and generally-aligned blade layers, each blade layer of the first group having a plurality of spaced-apart and generally-aligned static mixer blades each having a concave side facing generally in the intended upstream direction at an acute angle with respect to the intended upstream direction; and c) a second group of spaced-apart and generally-aligned blade layers, the blade layers of the second group aligned generally perpendicular to the blade layers of the first group, each blade layer of the second group having a plurality of spaced-apart and generally-aligned static mixer blades each having a concave side facing generally in the intended upstream direction at an acute angle with respect to the intended upstream direction, and the static mixer blades of the blade layers of the second group interdigitated with, and connected to, the static mixer blades of the blade layers of the first group, wherein a plane perpendicular to, and moving in the direction of, the directional flow axis will first and generally simultaneously strike at least one static mixer blade from each of at least two blade layers of each of the first and second groups.

5. The static mixer element of claim 4, wherein the acute angle of the static mixer blades of each blade layer of the first group is generally plus forty-five degrees, and wherein the acute angle of the static mixer blades of each blade layer of the second group is generally minus forty-five degrees.

6. The static mixer element of claim 4, wherein the static mixer blades of each blade layer of the first and second groups have a convex side opposing the concave side and have a generally uniform blade thickness between the convex and concave sides.

7. The static mixer element of claim 4, wherein the first group has at least three blade layers including two outermost blade layers and at least one intermediate blade layer disposed between the two outermost blade layers of the first group, wherein the second group has at least three blade layers including two outermost blade layers and at least one intermediate blade layer disposed between the two outermost blade layers of the second group, wherein the static mixer blades of the outermost blade layers of the first group are shorter in length than the static mixer blades of the at least one intermediate blade layer of the first group, and wherein the static mixer blades of the outermost blade layers of the second group are shorter in length than the static mixer blades of the at least one intermediate blade layer of the second group.

8. The static mixer element of claim 4, wherein the concave side of each of the static mixer blades has a generally constant radius of curvature.

9. The static mixer element of claim 4, wherein the concave side of at least one of the static mixer blades of each blade layer of each of the first and second groups is a generally semi-circular concave side.

10. The static mixer element of claim 4, wherein the static mixer blades of the blade layers of the first and second groups together have a generally circular outline when viewed along the directional flow axis.

11. A method for mixing first and second fluids comprising the steps of:

a) obtaining a pipe;

b) obtaining a static mixer element, wherein the static mixer element includes a directional flow axis which passes through the center of gravity of the static mixer element and which points in an intended downstream direction opposite to an intended upstream direction, and wherein the static mixer element includes a multiplicity of interdigitated static mixer blades each having a concave side facing generally in the intended upstream direction at an acute angle with respect to the intended upstream direction;

c) disposing the static mixer element in the pipe with the directional flow axis pointing downstream d) disposing the first fluid in the pipe upstream from the static mixer element; and e) disposing the second fluid in the pipe upstream from the static mixer element.

12. The method of claim 11, wherein the interdigitated static mixer blades are generally-perpendicularly interdigitated static mixer blades.

13. The method of claim 11, wherein the absolute value of the acute angle is generally forty-five degrees for each of the static mixer blades.

14. A method for mixing first and second fluids comprising the steps of:

a) obtaining a pipe;

b) obtaining a static mixer element, wherein the static mixer element includes:

(1) a directional flow axis which passes through the center of gravity of the static mixer element and which points in an intended downstream direction opposite to an intended upstream direction;

(2) a first group of spaced-apart and generally-aligned blade layers, each blade layer of the first group having a plurality of spaced-apart and generally-aligned static mixer blades each having a concave side facing generally in the intended upstream direction at an acute angle with respect to the intended upstream direction; and (3) a second group of spaced-apart and generally-aligned blade layers, the blade layers of the second group aligned generally perpendicular to the blade layers of the first group, each blade layer of the second group having a plurality of spaced-apart and generally-aligned static mixer blades each having a concave side facing generally in the intended upstream direction at an acute angle with respect to the intended upstream direction, and the static mixer blades of the blade layers of the second group interdigitated with, and connected to, the static mixer blades of the blade layers of the first group, wherein a plane perpendicular to, and moving in the direction of, the directional flow axis will first and generally simultaneously strike at least one static mixer blade from each of at least two blade layers of each of the first and second groups;

c) disposing the static mixer element in the pipe with the directional flow axis pointing downstream;

d) disposing the first fluid in the pipe upstream from the static mixer element; and e) disposing the second fluid in the pipe upstream from the static mixer element.

15. The method of claim 14, wherein the acute angle of the static mixer blades of each blade layer of the first group is generally plus forty-five degrees, and wherein the acute angle of the static mixer blades of each blade layer of the second group is generally minus forty-five degrees.

16. The method of claim 14, wherein the static mixer blades of each blade layer of the first and second groups have a convex side opposing the concave side and have a generally uniform blade thickness between the convex and concave sides.

17. The method of claim 14, wherein the first group has at least three blade layers including two outermost blade layers and at least one intermediate blade layer disposed between the two outermost blade layers of the first group, wherein the second group has at least three blade layers including two outermost blade layers and at least one intermediate blade layer disposed between the two outermost blade layers of the second group, wherein the static mixer blades of the outermost blade layers of the first group are shorter in length than the static mixer blades of the at least one intermediate blade layer of the first group, and wherein the static mixer blades of the outermost blade layers of the second group are shorter in length than the static mixer blades of the at least one intermediate blade layer of the second group.

18. The method of claim 14, wherein the concave side of each of the static mixer blades has a generally constant radius of curvature.

19. The method of claim 14, wherein the concave side of at least one of the static mixer blades of each blade layer of each of the first and second groups is a generally semi-circular concave side.

20. The method element of claim 14, wherein the static mixer blades of the blade layers of the first and second groups together have a generally circular outline when viewed along the directional flow axis, and wherein the circular outline has a diameter generally equal to the inside diameter of the pipe.

21. The method of claim 14, wherein the ratio of the viscosity of the first fluid to the viscosity of the second fluid is at least ten thousand to one.

22. A static mixer element assembly comprising:

a) a first static mixer element including:

1) a directional flow axis which passes through the center of gravity of the static mixer element and which points in an intended downstream direction opposite to an intended upstream direction;

2) a first group of spaced-apart and generally-aligned blade layers, each blade layer of the first group having a plurality of spaced-apart and generally-aligned static mixer blades each having a concave side facing generally in the intended upstream direction at an acute angle with respect to the intended upstream direction; and 3) a second group of spaced-apart and generally-aligned blade layers, the blade layers of the second group aligned generally perpendicular to the blade layers of the first group, each blade layer of the second group having a plurality of spaced-apart and generally-aligned static mixer blades each having a concave side facing generally in the intended upstream direction at an acute angle with respect to the intended upstream direction, and the static mixer blades of the blade layers of the second group interdigitated with, and connected to, the static mixer blades of the blade layers of the first group, wherein a plane perpendicular to, and moving in the direction of, the directional flow axis will first and generally simultaneously strike at least one static mixer blade from each of at least two blade layers of each of the first and second groups; and b) a second static mixer element substantially identical to the first static mixer element, disposed to have its directional flow axis substantially superimposed on the directional flow axis of the first static mixer element, rotated generally ninety degrees with respect to the first static mixer element about the directional flow axis of the first static mixer element, and disposed proximate the first static mixer element.

23. A method for mixing first and second fluids comprising the steps of:

a) obtaining a pipe;

b) obtaining a first static mixer element, wherein the first static mixer element includes:

(1) a directional flow axis which passes through the center of gravity of the first static mixer element and which points in an intended downstream direction opposite to an intended upstream direction;

(2) a first group of spaced-apart and generally-aligned blade layers, each blade layer of the first group having a plurality of spaced-apart and generally-aligned static mixer blades each having a concave side facing generally in the intended upstream direction at an acute angle with respect to the intended upstream direction; and (3) a second group of spaced-apart and generally-aligned blade layers, the blade layers of the second group aligned generally perpendicular to the blade layers of the first group, each blade layer of the second group having a plurality of spaced-apart and generally-aligned static mixer blades each having a concave side facing generally in the intended upstream direction at an acute angle with respect to the intended upstream direction, and the static mixer blades of the blade layers of the second group interdigitated with, and connected to, the static mixer blades of the blade layers of the first group, wherein a plane perpendicular to, and moving in the direction of, the directional flow axis of the first static mixer element will first and generally simultaneously strike at least one static mixer blade from each of at least two blade layers of each of the first and second groups;

c) disposing the first static mixer element in the pipe with the directional flow axis of the first static mixer element pointing downstream;

d) obtaining a second static mixer element substantially identical to the first static mixer element;

e) disposing the second static mixer element in the pipe downstream of the first static mixer element with the directional flow axis of the second static mixer element pointing downstream and with the second static mixer element rotated generally ninety degrees with respect to the first static mixer element about the directional flow axis of the first static mixer element;

f) disposing the first fluid in the pipe upstream from the first static mixer element; and g) disposing the second fluid in the pipe upstream from the first static mixer element.

24. The method of claim 23, wherein step e) also includes disposing the second static mixer element in contact with the first static mixer element.

* * * * *